US006293333B1

(12) United States Patent
Ponnappan et al.

(10) Patent No.: US 6,293,333 B1
(45) **Date of Patent: *Sep. 25, 2001**

(54) MICRO CHANNEL HEAT PIPE HAVING WIRE CLOTH WICK AND METHOD OF FABRICATION

(75) Inventors: Rengasamy Ponnappan, Centerville; John E. Leland, Kettering, both of OH (US)

(73) Assignee: The United States of America as represented by the Secretary of the Air Force, Washington, DC (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/389,269

(22) Filed: Sep. 2, 1999

(51) Int. Cl.[7] ..... F28F 7/00

(52) U.S. Cl. ..... 165/104.26; 165/104.33; 29/890.032; 361/700; 257/715

(58) Field of Search ..... 165/104.26, 104.21, 165/104.33; 29/890.032, 890.03; 361/687, 700; 257/715

(56) References Cited

U.S. PATENT DOCUMENTS

| | | | | |
|---|---|---|---|---|
| 3,598,180 | * | 8/1971 | Moore, Jr. | 165/104.26 |
| 3,680,189 | * | 8/1972 | Noren | 165/104.26 |
| 3,720,988 | | 3/1973 | Waters . | |
| 3,760,624 | | 9/1973 | Robinson . | |
| 3,789,920 | * | 2/1974 | Low et al. | 165/104.26 |
| 4,046,190 | * | 9/1977 | Marcus et al. | 165/104.26 |
| 4,047,198 | * | 9/1977 | Sekhon et al. | 165/104.26 |
| 4,116,266 | * | 9/1978 | Sawata et al. | 165/104.26 |
| 4,212,347 | * | 7/1980 | Eastman | 165/46 |
| 4,240,257 | * | 12/1980 | Rakowsky et al. | 165/104.26 |
| 4,353,415 | * | 10/1982 | Klaschka et al. | 165/104.21 |
| 4,394,344 | * | 7/1983 | Werner et al. | 165/104.26 |
| 4,846,263 | * | 7/1989 | Miyazaki et al. | 165/104.26 |
| 4,883,116 | * | 11/1989 | Seidenberg et al. | 165/104.26 |
| 5,029,389 | * | 7/1991 | Tanzer | 165/104.21 |
| 5,303,768 | * | 4/1994 | Alario et al. | 165/104.26 |
| 5,309,457 | * | 5/1994 | Minch | 374/34 |
| 5,520,244 | * | 5/1996 | Mundinger et al. | 165/104.33 |
| 5,642,776 | * | 7/1997 | Meyer et al. | 165/104.26 |
| 5,771,967 | * | 6/1998 | Hyman | 165/104.26 |
| 5,785,088 | | 7/1998 | Pai . | |
| 6,070,654 | * | 6/2000 | Ito | 165/104.26 |
| 6,216,343 | * | 4/2001 | Leland et al. | 29/890.032 |

* cited by examiner

*Primary Examiner*—Ira S. Lazarus
*Assistant Examiner*—Terrell McKinnon
(74) *Attorney, Agent, or Firm*—Richard A. Lambert; Bobby D. Scearce; Thomas L. Kundert

(57) ABSTRACT

A micro channel heat pipe and method of fabrication are disclosed. The micro channel heat pipe includes a wire cloth wick having micro capillary channels formed by a corrugation extrusion process. The wick is inserted into the heat pipe housing in a shrink fit, enhancing heat transfer. The porous nature of the wire cloth wick permits free passage of the working fluid within both the closed and open micro capillary channels, doubling the number of micro capillary channels available for heat transference.

9 Claims, 4 Drawing Sheets

MICRO CHANNEL HEAT PIPE HAVING WIRE CLOTH WICK AND METHOD OF FABRICATION

RIGHTS OF THE GOVERNMENT

The invention described herein may be manufactured and used by or for the Government of the United States for all governmental purposes without the payment of any royalty.

BACKGROUND OF THE INVENTION

The present patent application document is somewhat related to the copending and commonly assigned patent application document "MICRO CHANNEL HEAT PIPE HAVING CORRUGATED FIN ELEMENTS AND METHOD OF FABRICATION", AFD 00384, Ser. No. 09/389,270, filed on even date herewith. The contents of that even filing date application are hereby incorporated by reference herein.

The present invention relates generally to heat dissipating devices and more particularly to a micro channel heat pipe and method of fabrication.

As is well known in the art, heat pipes are closed, self contained devices that contain a volatile working fluid designed to transport thermal energy efficiently. In general, heat pipes have an inner cavity lined with a wick or grooves designed to provide a capillary structure for the transport of the working fluid.

In operation, the heat pipe takes advantage of the latent heat of vaporization of the working fluid. Heat is applied to one portion of the device, causing evaporation of the fluid in that portion of the chamber. The fluid vapor moves to a cooler portion of the device whereupon it condenses. The condensed fluid returns, and the action repeats itself.

As can be imagined, this vaporization and condensation action is continuous and provides for a very efficient means of transportation of thermal energy. The heat pipe is a sealed unit and requires no additional energy input to enable operation. Thus it is very efficient and is useful in a wide array of applications.

A current trend towards micro miniaturization of electronic components and high power devices gives rise to the desirability of correspondingly miniaturized cooling devices. As a result, attempts have been made to miniaturize heat pipes. However, as heat pipes are miniaturized, it becomes increasingly difficult to fabricate an effective wick structure to provide acceptable heat transfer operation. For example, forming of very narrow rectangular channels, 0.2 mm×0.9 mm or similar sizes and shapes within the internal walls of tubes with hydraulic diameter in the range of 5–10 mm is difficult. Appropriate groove cutting tools, extrusion dies and the like, necessary for cutting such small channels often provide unsatisfactory results and are expensive.

A need exists therefore for a micro channel heat pipe which provides high efficiency operation while simultaneously eliminating the difficulties encountered in fabrication heretofore encountered to date.

SUMMARY OF THE INVENTION

It is therefore a primary object of the present invention to provide a micro channel heat pipe and method of fabrication overcoming the limitations and disadvantages of the prior art techniques.

It is another object of the invention to provide a micro channel heat pipe that can be readily manufactured from known techniques.

It is still another object of the present invention to provide an improved micro channel heat pipe for efficient utilization in micro-miniature applications.

It is yet another object of the present invention to provide an improved micro channel heat pipe having a wire cloth wick for efficient heat transfer in micro-miniature applications.

These and other objects of the invention will become apparent as the description of the representative embodiments proceeds.

In accordance with the foregoing principles and objects of the invention, a micro channel heat pipe and method of fabrication are described. The method includes forming micro channels in a fine mesh wire cloth wick. The wick is inserted into the heat pipe housing and preferably includes a compression or shrink fit.

Micro channel heat pipes are characterized as having at least one capillary channel such that $r_c/r_h \geqq 1$ where $r_c$ is the capillary radius and $r_h$ is the hydraulic radius of the flow channel. In order to provide efficient operation, the capillary channels in micro channel heat pipes are quite small, for example, 0.2 mm or less. The known groove forming methods such as rolling, dicing saw cutting, electrodischarge machining, etc. are difficult to enact properly, can provide unsatisfactory results and are expensive to perform.

As stated, the micro channel heat pipe of the present invention includes a wick formed from wire cloth. There are many benefits realized by utilizing wire cloth to form the wick of the present invention. By forming the wick from wire cloth, micro capillary channels can be easily formed therein by the ready application of known fin making processes. Since the wick thus formed is porous to the working fluid, the number of capillary channels available for heat transfer is doubled to incorporate both open and closed channels. As can be appreciated, this greatly enhances the operational efficiency of a micro channel heat pipe fabricated according to the teachings of the present invention. Moreover, the capillary action of the wick is greatly enhanced by the tight mesh of the wire cloth. Also, the wire cloth enables circumferential fluid distribution within the channels due to capillary action. This is not possible with the solid wall channels of the prior art.

Good mechanical contact between the wick and the heat pipe housing is assured by a shrink fit insertion process. More specifically, the housing is heated prior to insertion of the wick. When the housing cools and the assembly reaches an equilibrium temperature, a net compressive force will be exerted on the wick assuring good thermal contact, enhancing overall effectiveness.

By the avoidance of the complicated groove machining of the known techniques, another advantage of the present invention becomes apparent. More specifically, in order to machine the micro capillary channels within the housing, the housing correspondingly would have to be split longitudinally in order to provide access for machining purposes. However, by utilizing the teachings of the present invention, the housing need not be split because the wick is formed separately and then inserted into the housing. Advantageously, this contributes to low cost mass production.

BRIEF DESCRIPTION OF THE DRAWING

The accompanying drawing incorporated in and forming a part of the specification, illustrates several aspects of the present invention and together with the description serves to explain the principles of the invention. In the drawing.

DETAILED DESCRIPTION OF THE INVENTION

Figure 1:
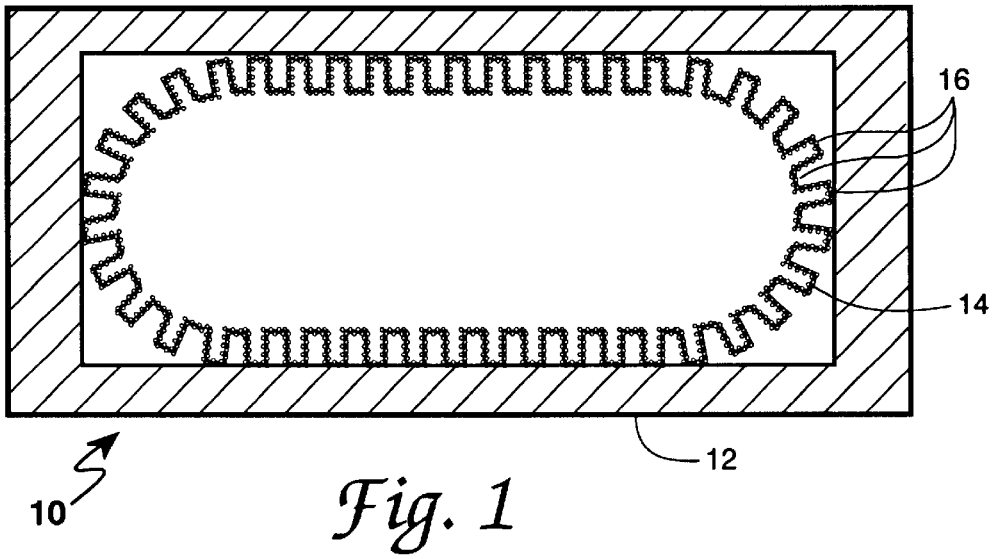
FIG. 1 is a cross sectional view of a heat pipe fabricated according to the teachings of the present invention.

Reference is made to the drawing figures showing the micro channel heat pipe of the present invention. The micro channel heat pipe operates automatically and continuously by transferring heat from the heated, evaporator region to the cooler, condenser region, providing a self contained device for efficient heat transfer.

FIG. 1 shows the micro channel heat pipe 10 in cross section. The heat pipe 10 includes a housing 12. The housing 12 can be made from many different materials depending on application. For example, copper can be utilized due to its high heat transfer characteristics and ready commercial availability. Other representative choices of material include but are not considered limited to aluminum, stainless steel or nickel alloys, for example. Simply by way of example, and in order to illustrate the teachings and principles of the present invention, a ¼ in.×½ in. 0.048 in. wall tube is described. As can be appreciated, the size and configuration of tubing available to the skilled artisan is vast.

As shown in FIG. 1, a wick 14 is inserted into the housing 12. The wick includes a plurality of micro capillary channels 16. According to an important aspect of the present invention, and as will be described in more detail below, the wick 14 is fabricated from fine mesh wire cloth. In the preferred embodiment the wire cloth is a 150×150 $inch^{-1}$ mesh copper screen cloth.

As the trend towards micro miniaturization of electronic components continue, it becomes increasingly difficult to fabricate correspondingly sized micro channel heat pipes. The problem is further compounded by the fact that the heat flux requirements increase as component sizes decrease. As a result, very small dimensions become necessary for efficient capillary channel and corresponding heat pipe operation. Micro channel heat pipes are characterized as having at least one capillary channel such that $r_c/r_h \geqq 1$ where $r_c$ is the capillary radius and $r_h$ is the hydraulic radius of the flow channel and capillary channels in the order of 0.2 mm or less are required for efficient micro channel heat pipe operation. The typical machining methods such as rolling, dicing saw cutting, electrodischarge machining, etc. are difficult to effect properly, can provide unsatisfactory results and are expensive to perform. Background material related to micro channel heat pipes which may be helpful in understanding the invention may be found by reference to "Micro/Miniature Heat Pipe Technology for Electronic Cooling", by Faghri et al., WL-TR-97-2083, Wright Laboratory, Wright-Patterson AFB, Ohio (July 1997), and the references cited therein, the entire teachings of which are incorporated by reference herein.

Advantageously, by forming the wick 14 of the present invention from wire cloth independently from the housing, the above described machining limitations have been dramatically overcome. More specifically, the desired micro capillary channels 16 can be readily formed in the wire cloth by known corrugation extrusion techniques such as described in U.S. Pat. No. 3,760,624, for example.

Figure 2A:
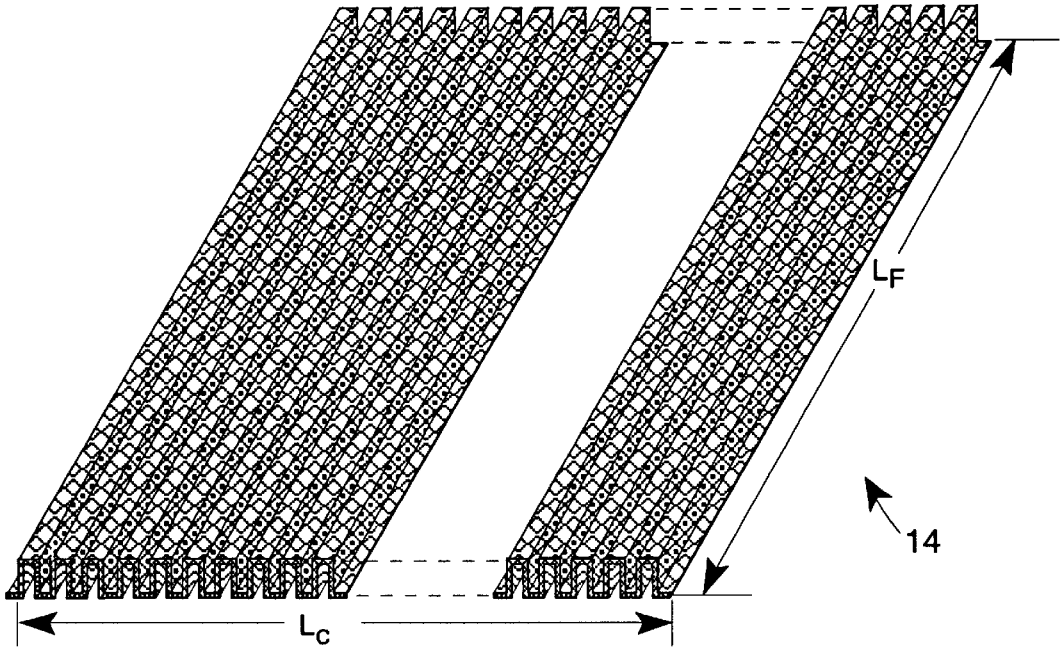
FIG. 2A is a perspective view of the wick of the present invention after formation of the capillary channels.
Figure 2B:
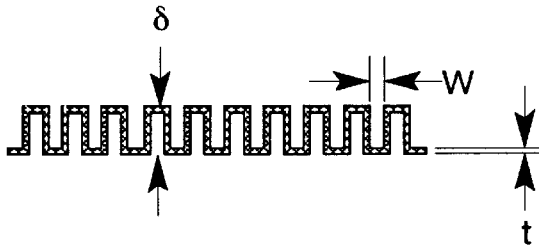
FIG. 2B is a cross sectional view of a portion of the wick fabricated according to the teachings of the present invention.

The wick 14 after formation of the micro capillary channels 16, is illustrated in FIG. 2A. The dimensions $L_C$ and $L_F$ as shown are dependent on the dimensions of the heat pipe housing, which vary according to application. The capillary channel depth δ as shown in FIG. 2B, is determined according to a predetermined aspect ratio of δ/w. In the preferred embodiment, the aspect ratio is 4.5, with a capillary channel depth δ of 0.9 mm, a width w of 0.2 mm, a wire cloth thickness t of 0.11 mm and the ratio $r_c/r_h$ of 2.22.

Figure 7:
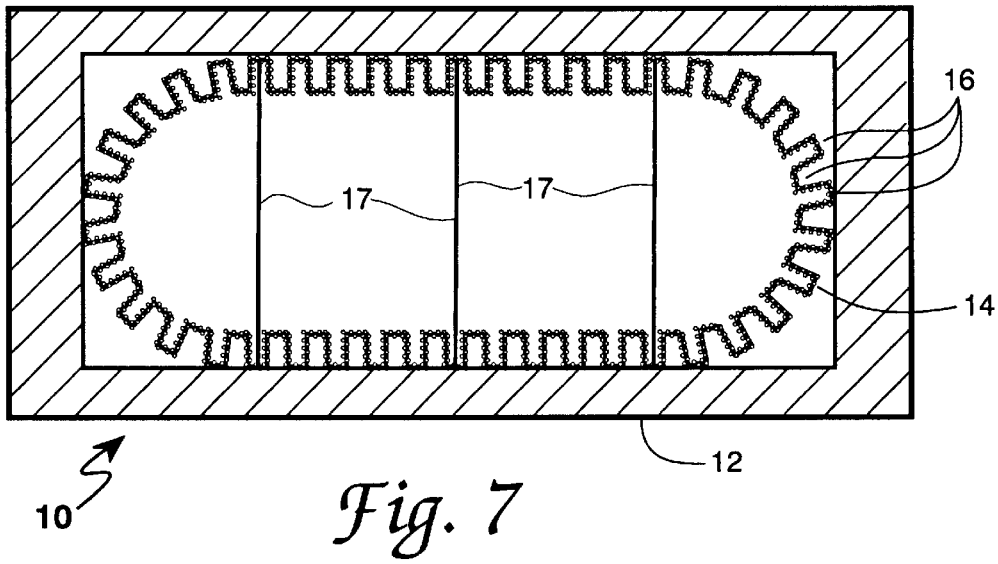
FIG. 7 is a cross sectional view of a heat pipe fabricated according to the teachings of the present invention illustrating the inclusion of stiffeners.
Figure 3:
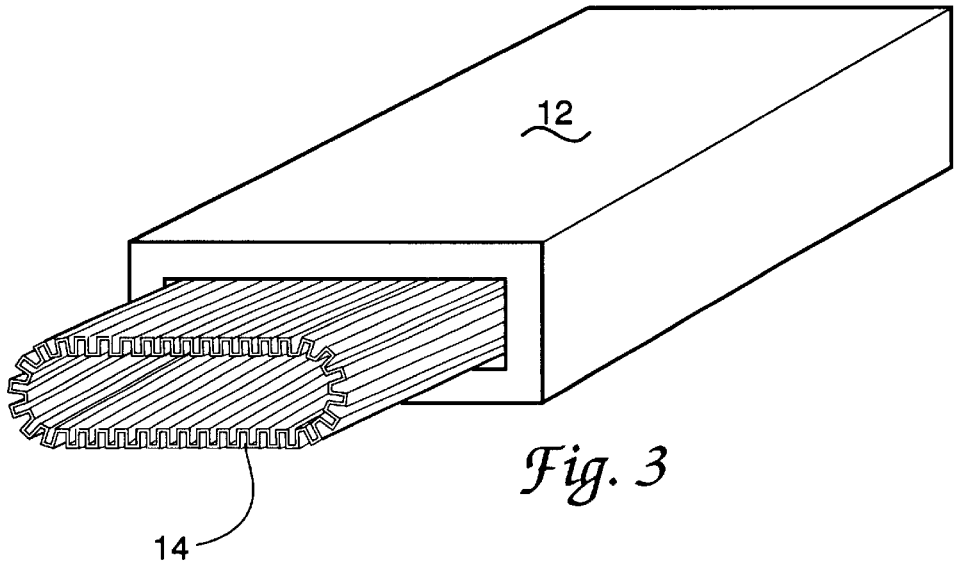
FIG. 3 is a perspective view of the wick fabricated according to the teachings of the present invention being inserted into the heat pipe housing.

FIG. 3 illustrates a step in the process of fabrication of the micro channel heat pipe 10 of the present invention. The wick 14 is shown being inserted into the housing 12. Preferably, the wick 14 is retained within the housing 12 by a slight shrink fit. Advantageously, this shrink fit can be readily achieved by heating the housing 12 to an elevated temperature, such as 200° F. prior to the introduction of the wick 14. The wick 14 is inserted at room temperature, and when the assembly cools to an equilibrium temperature, a net compressive force is exerted on the wick 14. This assures a good mechanical fit, greatly enhancing thermal conduction, as well as simplifying fabrication. As shown in FIG. 7, one or more stiffeners 17 may be added, if desired, to force the wick 14 into contact with the housing 12. The stiffeners 17 can be made porous by the addition of holes so as to allow free transference of vapor and fluid throughout the interior of the micro channel heat pipe 10.

Figure 4:
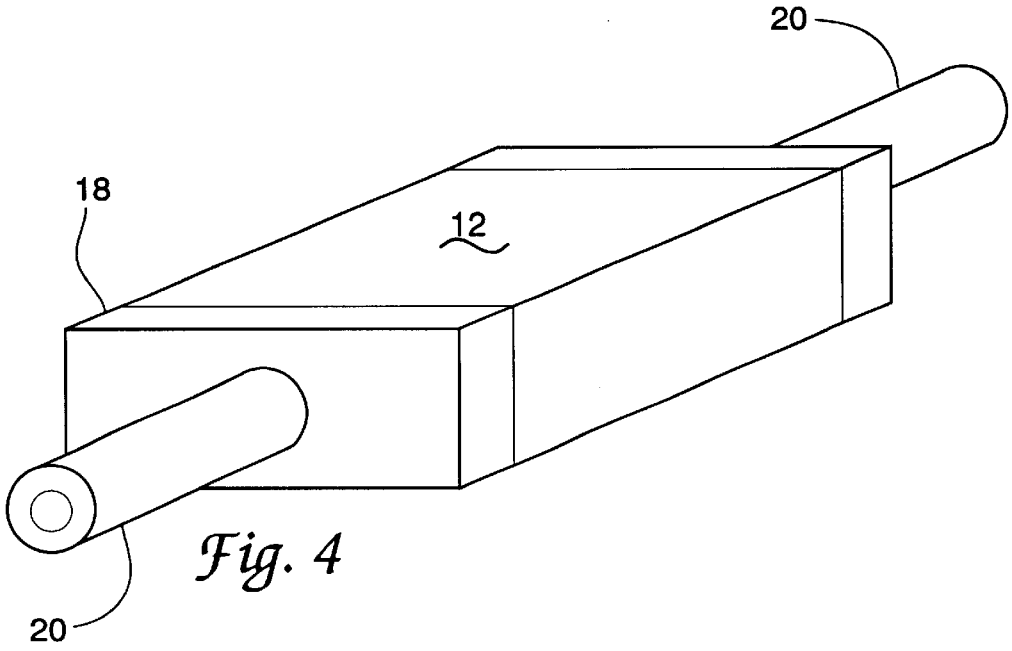
FIG. 4 is a perspective view of the heat pipe fabricated according to the teachings of the present invention, showing the end caps attached to the housing.

As shown in FIG. 4, the housing 12 is enclosed by the addition of end caps 18 incorporating fill tubes 20. After attachment of the end caps 18, a suitable quantity of working fluid F is introduced into the micro channel heat pipe 10 using known vacuum transfer and fill procedures, via the fill tubes 20. Generally, a quantity of working fluid F to saturate the wick structure is considered sufficient. The fill tubes 20 then can be pinched and sealed and excess length removed from the end caps 18 if desired. The working fluid F can be any number of suitable fluids, depending on temperature requirements. Representative fluids include but are not considered limited to water, alcohol, acetone, ammonia or refrigerant.

Since the wire cloth wick 14 contains micro pores, (0.085 mm in the preferred embodiment) the present invention advantageously provides for enhanced heat transfer effectiveness. This is because the micro pores work as a capillary pumping wick, providing a desirable capillary pumping action to compliment the flow of working fluid F within the channels 16 during operation. This composite wick arrangement provides enhanced performance characteristics such as better evaporator priming and increased evaporator heat flux, advantages not possible in the prior art machined groove design. The dramatic advantage of the present invention is clearly shown by comparison to the prior art device

Figure 6:
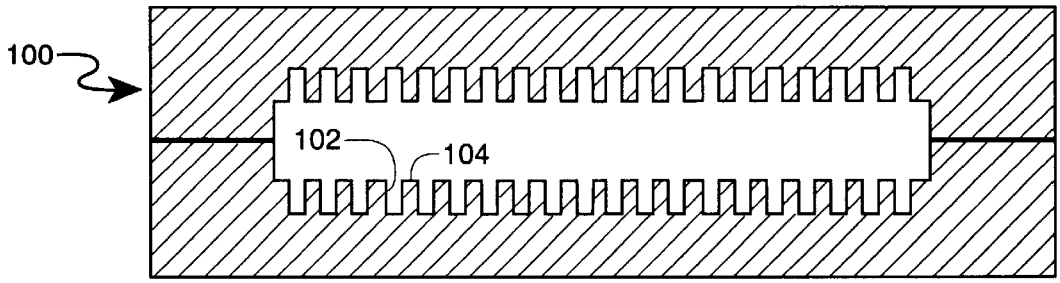
PRIOR ART Fig. 6
FIG. 6 is a cross sectional view of a prior art heat pipe.
Figure 5:
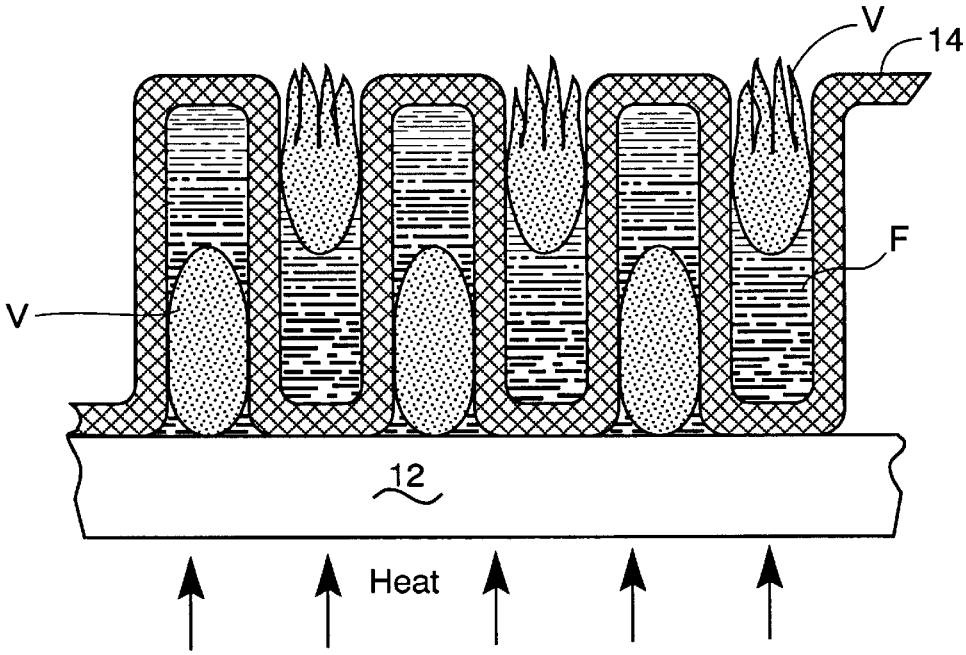
FIG. 5 is a cross sectional view of the wick fabricated according to the teachings of the present invention illustrating the desirable inverted meniscus heat transfer operation enabled by the present invention.

100 illustrated in FIG. 6. As shown in this prior art device, only the open channels 102 are available for working fluid F flow. The ridges 104, obviously cannot transfer working fluid. But, according to the teachings of the present invention, the wire cloth wick 14, being permeable to the working fluid F, presents an equal number of closed and open channels for working fluid F flow as well as heat transference. This also has the desirable result of providing inverted-meniscus type evaporation during operation as shown in FIG. 5. More specifically, the working fluid F vaporizes randomly in areas designated V. This in turn enables very high heat flux and has the further advantage of rendering the wick 14 dry-out tolerant. These advantages greatly enhance the efficiency of the micro channel heat pipe 10 of the present invention. Moreover, it should also be appreciated that due to the porous nature of the wire cloth, the wick 14 facilitates capillary pumping action of the working fluid F, enhancing transport of the condensed fluid F from the condenser region (not shown) back to the heated, evaporator region (not shown), as well as facilitating working fluid F wicking in the circumferential direction.

In summary, numerous benefits have been described from utilizing the principles of the present invention. In particular, the micro channel heat pipe 10 utilizes a fine mesh wire cloth wick 14 having micro capillary channels formed therein, providing enhanced heat transfer operation and presenting relative ease of fabrication.

The foregoing description of the preferred embodiment has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the inventions in various embodiments and with various modifications as are suited to the particular scope of the invention as determined by the appended claims when interpreted in accordance with the breadth to which they are fairly, legally and equitably entitled.

We claim:

1. A method of fabricating a micro channel heat pipe, comprising the steps of:

providing a housing having an inner cavity, said housing having a longitudinal axis;

forming, by corrugation extrusion, a one piece porous wire cloth wick to have a plurality of adjacent axial rectangular open and closed micro capillary channels formed therein, said micro capillary channels characterized by the relation $r_c/r_h \geqq 1$, wherein $r_c$ is the capillary radius and $r_h$ is the hydraulic radius of said channels;

inserting said wick within said inner cavity such that said wick contacts at least a portion of the surface of said inner cavity, said wick extending continuously along said longitudinal axis of said housing;

attaching a pair of end caps to enclose said housing; and, introducing a sufficient quantity of working fluid into said housing.

2. The method of claim 1 wherein said wick is inserted in a shrink fit manner.

3. The method of claim 2 wherein said inserting step is preceded by the step of heating said housing.

4. The method of claim 1 wherein said working fluid is selected from the group consisting of water, alcohol, acetone, ammonia and refrigerant.

5. The method of claim 1 wherein said housing comprises a material selected from the group of copper, aluminum, stainless steel and nickel alloy.

6. The method of claim 1 wherein said attaching step is preceded by the step of inserting a stiffener for forcing said wick into contact with said housing.

7. A micro channel heat pipe, comprising:

a housing having an inner cavity;

a porous wire cloth wick disposed within said housing, said wick having a plurality of adjacent axial rectangular open and closed micro capillary channels formed therein, said micro capillary channels characterized by the relation $r_c/r_h \geqq 1$, wherein $r_c$ is the capillary radius and $r_h$ is the hydraulic radius of said channels, said wick contacting at least a portion of the surface of said inner cavity; and, a sufficient quantity of working fluid within said housing, said working fluid saturating said wick and permeating across said open and closed micro capillary channels of said wick, whereby both of said open and said closed channels are presented for fluid flow and heat transference.

8. The heat pipe of claim 7 wherein said working fluid is selected from the group consisting of water, alcohol acetone, ammonia and refrigerant.

9. The heat pipe of claim 7 wherein said housing comprises a material selected from the group of copper, aluminum, stainless steel and nickel alloy.

* * * * *